US005946837A

United States Patent [19]

Ackers

[11] Patent Number: 5,946,837

[45] Date of Patent: Sep. 7, 1999

[54] SIGN

[75] Inventor: Bernard Lawrence Philip Ackers, Middlewich, United Kingdom

[73] Assignee: Gradus Limited, Chesire, United Kingdom

[21] Appl. No.: 08/664,159

[22] Filed: Jun. 14, 1996

[30] Foreign Application Priority Data

Jun. 15, 1995 [GB] United Kingdom ..... 9512204

[51] Int. Cl.[6] ..... G09F 13/00

[52] U.S. Cl. ..... 40/558; 40/570; 40/578; 362/267; 362/800

[58] Field of Search ..... 40/570, 558, 578, 40/580; 362/267, 800

[56] References Cited

U.S. PATENT DOCUMENTS

| | | | |
|---|---|---|---|
| 1,932,494 | 10/1933 | Walters | 40/580 |
| 2,129,780 | 9/1938 | Nickel | 40/558 X |
| 2,752,708 | 7/1956 | Sundquist | 40/580 X |
| 3,514,589 | 5/1970 | Huber | 362/293 |
| 3,931,689 | 1/1976 | Shine | 40/570 |
| 4,271,621 | 6/1981 | Garcia et al. | 40/570 |
| 4,561,203 | 12/1985 | MacDonald, Jr. et al. | 40/570 |
| 4,654,761 | 3/1987 | Walsh | 362/80 |
| 4,851,972 | 7/1989 | Altman | 362/267 |
| 4,909,604 | 3/1990 | Kobayashi et al. | 350/345 |
| 5,022,627 | 6/1991 | Beghelli | 40/570 X |
| 5,528,474 | 6/1996 | Roney et al. | 362/800 X |
| 5,564,816 | 10/1996 | Arcadia et al. | 362/183 |
| 5,611,163 | 3/1997 | Smith | 40/570 |
| 5,709,453 | 1/1998 | Krent et al. | 362/80 |
| 5,785,418 | 7/1998 | Hochstein | 362/373 |

*Primary Examiner*—Brian K. Green
*Assistant Examiner*—Andrea Chop
*Attorney, Agent, or Firm*—Salter & Michaelson

[57] ABSTRACT

A sign comprises a housing (10) having a part having information and a part which is transparent (12, 14, 16). A cold cathode (28) is disposed in the housing and the housing is filled with resin to encapsulate the cold cathode and electrical connections (30, 32) thereto.

19 Claims, 2 Drawing Sheets

SIGN

This invention relates to signs capable of illumination in an emergency.

In environments such as ships, hotels, institutions and the like it is important that in the event of an emergency, such as a fire or shipwreck, illuminated signs are provided to guide people with certainty to exits. Such illuminated signs must be capable of operating under very sever conditions, for example they must be able to operate in extremes of heat and damp. Signs which are not capable of illumination can easily be made to resist those conditions, but they may not be visible, for example in a fire or conditions where there is a lot of smoke.

The present invention has been made in order to deal with this problem.

According to the invention there is provided a sign capable of illumination in severe conditions comprising a housing, at least a part of said housing carrying information and at least a part of said housing being transparent or translucent and at least one electrically driven illuminable means in said housing, characterised in that electrical circuitry for driving the illuminable means is located in the housing, said circuitry being encapsulated.

Preferably the illuminable means is a cold cathode. With the invention the use of one or more cold cathodes, whose diameter is generally of the order of 3 to 4 mm means that the depth of the housing can be kept small, for example about 10 mm. This is particularly advantageous if the sign is to be mounted in a location where there is restricted space, such as a narrow corridor or stair. Sometimes the sign needs to be mounted on a wall, but adjacent the floor. The small depth helps to prevent damage by the feet of people passing by.

The information is preferably carried on the front face of the sign. The information can be in the form of a transparent area or areas, such as an arrow or a running figure, surrounded by coloured areas which will help to focus attention on the information carried provided by the transparent area or areas. Of course, other arrangements are possible. If desired a diffuser may be provided between the or each cold cathode and the part of the housing that provides the information.

In addition to encapsulation of the circuitry in the housing other items can be encapsulated such as the illuminable means. It is also preferred that the housing be sealed.

Specific embodiments of the invention will now be described by way of examples with reference to the accompanying drawings wherein:

FIG. 1 shows a front perspective view, partly in section, of the sign; and

FIG. 2 shows a sign having light emitting diodes.

A specific embodiment of the invention will now be described by way of example with reference to the accompanying drawings.

Figure 1:
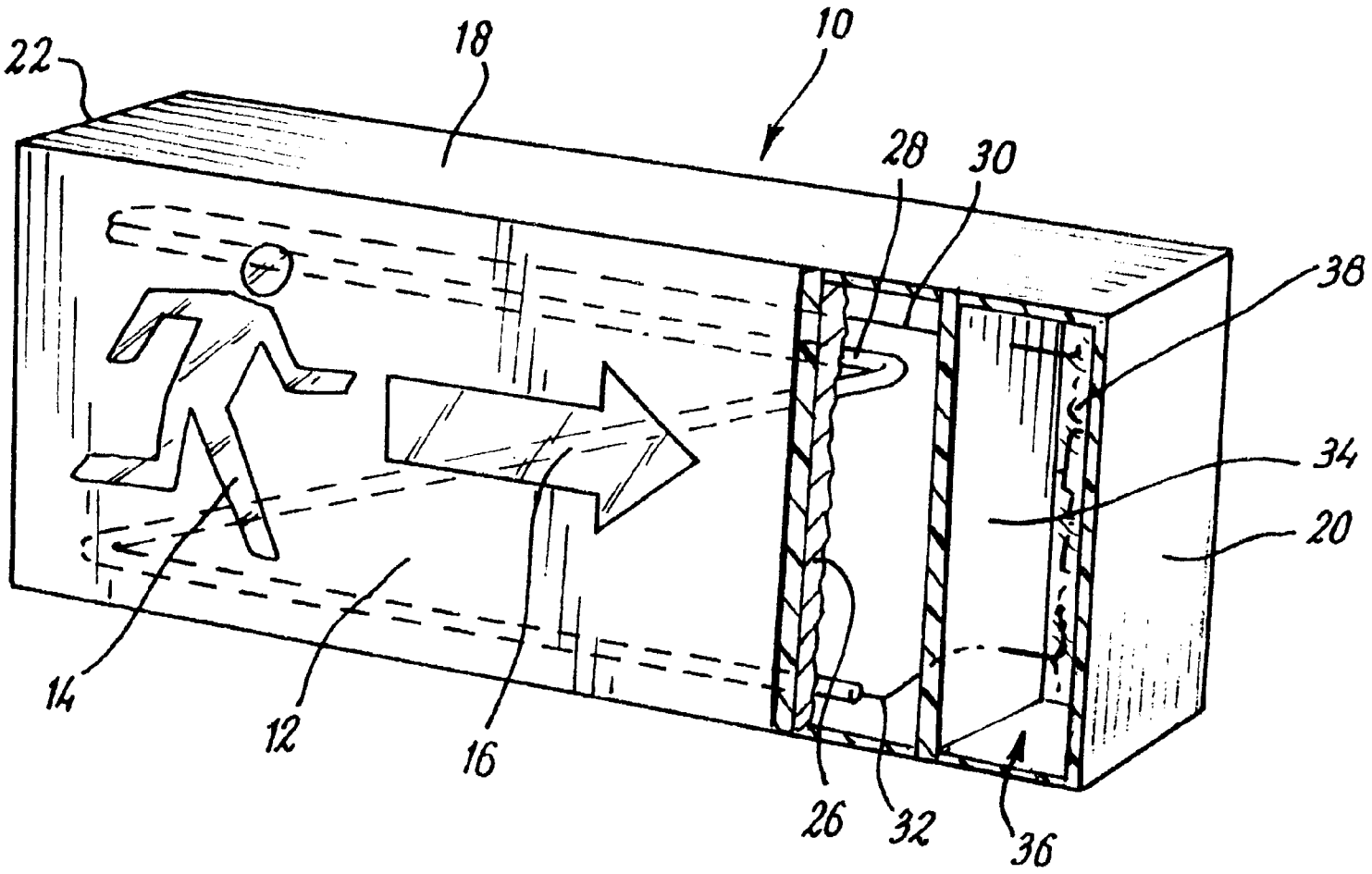
FIG. 1 is a perspective view, partly in section, of a first embodiment of the sign of the present invention.

Referring to FIG. 1 the sign comprises a housing 10 which may be of plastic, for example polycarbonate or other plastic which is flame retardant. In the embodiment illustrated the front face 12, of the housing has transparent areas 14 and 16 comprising a running figure and an arrow. The front of the housing surrounding the information 14, 16 may be coloured so as to be translucent or opaque as can the sides of the housing 18, 20 and 22.

A diffuser 26 is positioned inside the housing adjacent the front face and behind the diffuser a cold cathode 28 is located. In the illustrated embodiment the cold cathode is formed as a zig-zag, but it is to be understood that any configuration of cold cathode may be chosen and any number of cold cathodes can be used. Electrical conductors 30, 32 are connected to the cold cathode inside the housing.

A partition 34 is provided adjacent one end of the housing to define, with the housing walls, an enclosure 36. Circuitry such as a printed circuit board 38 for driving the cold cathode is disposed in the enclosure 36, conductors 30 and 32 extending through the partition 34 to the circuitry.

When the internal components have been installed in the housing, the enclosure 36 is filled with a resin, for example a polycarbonate or other plastic having flame retardant properties so as to encapsulate the internal components in the enclosure, in particular the circuitry for the cold cathode and the connections thereto. If the encapsulating resin is to be permitted to be disposed between the cold cathode and the front face of the housing then the resin must be one which, on curing, is transparent or translucent.

The invention is not restricted to the above described embodiment and many variations and modifications can be made. For example the sign can be illuminated with one or more LEDS (see FIG. 2) or other devices of small dimensions.

Figure 2:
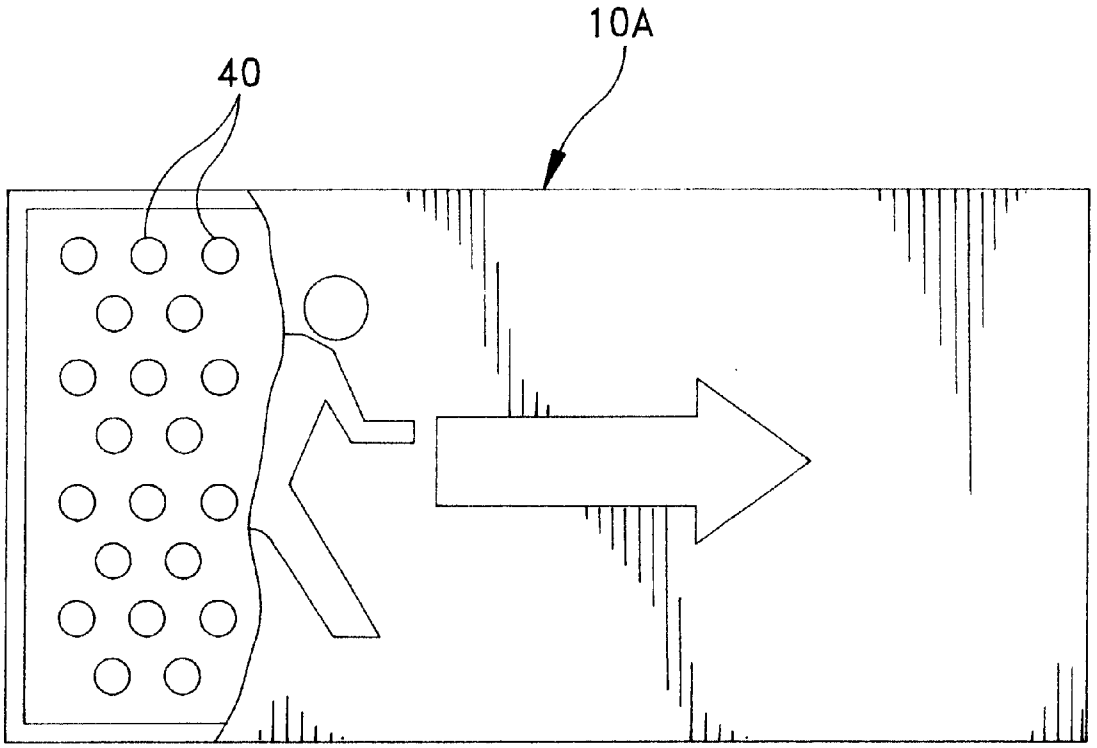
FIG. 2 is a front view, partly in section, of a second embodiment of the sign.

Referring to FIG. 2, a sign 10A is illustrated, partly in section, showing the use of a plurality of LED's 40 mounted within the housing.

What is claimed is:

1. A sign comprising:

a housing having a partition wall which divides the housing into a first enclosure and a second enclosure;

an electric light emitting member mounted within the first enclosure of said housing, said housing having at least one light transmissible portion wherein light emitted from said light emitting member is transmissible through said light transmissible portion;

a circuit board including an electrical circuit for driving operation of said light emitting member, said electrical circuit being disposed within said second enclosure of said housing, said electrical circuit being encapsulated in an encapsulating material which at least partially fills the second enclosure of the housing; and electrical connectors connected between said light emitting member and said electrical circuit;

wherein said encapsulation material protects said electrical circuit from adverse operating conditions while allowing said electric light emitting member to be separately replaced.

2. The sign as claimed in claim 1 wherein said light emitting member comprises a cold cathode.

3. The sign as claimed in claim 1 wherein said light emitting member comprises at least one light emitting diode.

4. The sign as claimed in claim 3 wherein said encapsulation material comprises a resin.

5. The sign as claimed in claim 4 wherein said encapsulation material is light transmissible.

6. The sign as claimed in claim 5 wherein said encapsulation material includes a flame retardant compound.

7. The sign as claimed in claim 6 wherein said housing is sealed.

8. The sign as claimed in claim 4 wherein said encapsulation material includes a flame retardant compound.

9. The sign as claimed in claim 4 wherein said housing is sealed.

10. The sign as claimed in claim 3 wherein said encapsulation material is light transmissible.

11. The sign as claimed in claim 10 wherein said encapsulation material includes a flame retardant compound.

12. The sign as claimed in claim 3 wherein said encapsulation material includes a flame retardant compound.

13. The sign as claimed in claim 3 wherein said housing is sealed.

14. The sign as claimed in claim 1 wherein said encapsulation material comprises a resin.

15. The sign as claimed in claim 11 wherein said encapsulation material is light transmissible.

16. The sign as claimed in claim 15 wherein said encapsulation material includes a flame retardant compound.

17. The sign as claimed in claim 11 wherein said encapsulation material includes a flame retardant compound.

18. The sign as claimed in claim 1 further comprising a diffuser member provided between said light emitting member and said light transmissible portion of said housing.

19. The sign as claimed in claim 11 wherein said housing is sealed.

* * * * *